US010595700B2

(12) United States Patent
Zorzo

(10) Patent No.: US 10,595,700 B2
(45) Date of Patent: Mar. 24, 2020

(54) CLEANING CLOTH FITTED WITH A RECESS CAPABLE OF BEING JOINED TO A MOP BASE

(71) Applicant: Renato Zorzo, S. Giustina in Colle (IT)

(72) Inventor: Renato Zorzo, S. Giustina in Colle (IT)

( * ) Notice: Subject to any disclaimer, the term of this patent is extended or adjusted under 35 U.S.C. 154(b) by 0 days.

(21) Appl. No.: 15/589,263

(22) Filed: May 8, 2017

(65) Prior Publication Data

US 2017/0367555 A1 Dec. 28, 2017

Related U.S. Application Data

(63) Continuation of application No. 14/394,063, filed on Oct. 10, 2014, now abandoned.

(51) Int. Cl.

| | |
|---|---|
| ***A47L 13/256*** | (2006.01) |
| ***A47L 13/44*** | (2006.01) |
| ***A47L 13/16*** | (2006.01) |

(52) U.S. Cl.

CPC ..... *A47L 13/256* (2013.01); *A47L 13/16* (2013.01); *A47L 13/44* (2013.01)

(58) Field of Classification Search

CPC . A47L 1/15; A47L 13/16; A47L 13/20; A47L 13/24; A47L 13/254; A47L 13/256; A47L 13/44; A47L 13/46; A47L 23/22

USPC ... 15/231, 232, 228, 247, 208, 209.1, 220.1, 15/215; 451/523–525, 354, 502, 503

See application file for complete search history.

(56) References Cited

U.S. PATENT DOCUMENTS

| | | | | | |
|---|---|---|---|---|---|
| 1,298,386 | A * | 3/1919 | Plunkett | E04F 21/06 | 15/231 |
| 1,699,840 | A * | 1/1929 | Goldblatt | E04F 21/06 | 15/231 |
| 2,306,944 | A * | 12/1942 | Gray | A47L 13/256 | 15/209.1 |
| 3,545,876 | A * | 12/1970 | Leland | A47L 13/29 | 15/231 |
| 4,930,267 | A * | 6/1990 | Hill | B24B 23/04 | 451/354 |
| 5,410,771 | A * | 5/1995 | Bereza | A47L 1/06 | 15/144.2 |
| 7,404,227 | B2 * | 7/2008 | Otsuka | A47L 13/20 | 15/208 |
| 2007/0151064 | A1 * | 7/2007 | O'Connor | A47L 13/20 | 15/231 |
| 2007/0271715 | A1 * | 11/2007 | Scoralle | A47L 23/22 | 15/104.92 |
| 2008/0016634 | A1 * | 1/2008 | Vosbikian | A47L 13/12 | 15/104.93 |
| 2008/0256731 | A1 * | 10/2008 | Nobile | A47L 13/257 | 15/119.2 |

(Continued)

FOREIGN PATENT DOCUMENTS

| | | | |
|---|---|---|---|
| DE | 19960580 | * | 6/2001 |
| JP | 9-28655 | * | 2/1997 |
| JP | 10-52394 | * | 2/1998 |

(Continued)

*Primary Examiner* — Mark Spisich

(74) *Attorney, Agent, or Firm* — QuickPatents, Inc.; Kevin Prince

(57) ABSTRACT

A cleaning cloth, and in particular a cleaning cloth for floors suitable for being attached to a mop base, and fitted with special coupling devices that make it easy to attach it to the mop base and ensure it is held securely.

12 Claims, 3 Drawing Sheets

(56) References Cited

U.S. PATENT DOCUMENTS

2013/0198990 A1* 8/2013 Hawkins ..... A47L 23/266
15/215

FOREIGN PATENT DOCUMENTS

JP 11-99114 * 4/1999
WO 2011/153717 * 12/2011

* cited by examiner

CLEANING CLOTH FITTED WITH A RECESS CAPABLE OF BEING JOINED TO A MOP BASE

CROSS-REFERENCE TO RELATED APPLICATIONS

This application is a continuation of U.S. patent application Ser. No. 14/394,063, filed on Oct. 10, 2014, now abandoned, and incorporated herein by reference.

STATEMENT REGARDING FEDERALLY SPONSORED RESEARCH AND DEVELOPMENT

Not Applicable.

FIELD OF THE INVENTION

This invention concerns a cleaning cloth, and specifically a cleaning cloth for floors to be used in combination with a mop base.

DISCUSSION OF RELATED ART

It is well known that most floor cleaning is carried out using and a cleaning cloth attached underneath a base; this base is solidly attached to, or hinged to, a handle for use by an operator.

These cleaning cloths have always been the subject of improvements with the aim of helping operators carry out their task, especially regarding the quality of the cleaning.

In addition to this aspect, one of the main things operators want from a new type of cleaning cloth is that it can facilitate their work both in terms of the time employed as well as productivity.

In fact, in normal cleaning operations there is a normal operating method that consists of the cleaning of floors with breaks to constantly refresh the cloth when it is excessively dirty to carry on cleaning.

This refreshment of the cloth in practice means its replacement, or else its washing and wringing.

A lot of time is taken up, then, in a non-productive way, suspending the cleaning operations and going to the store to get a new cloth and returning to the cleaning area to restart the cleaning operation that had been suspended.

In addition to the above-mentioned frequent replacement of the cloth, since many cloth bases have a gripping and retention device for the cloth that is particularly intricate and/or articulated, a fair amount of time is needed for the operator to align the base with the cloth when attaching the cloth to the base correctly. Mainly because of the above-mentioned reasons it is clear that the operator tends to put off replacing the cloth for as long as possible, to the detriment of the quality of the cleaning.

In order to reduce the time needed to attach the cloth to the base, some operators prefer less complicated mop bases, where the replacement of the cloth is quick and easy, even if the attachment is somewhat approximate and requires a manual intervention to attach and detach the cloth from the base.

This latter operation of directly handling the dirty cloth with your hands is anyway one that operators really do not like.

This manual operation sometimes is also required when the cloth unexpectedly detaches from the base during normal cleaning operations, leading the operator to truly dislike such bases that cannot guarantee a secure grip of the cloth.

Below are the main drawbacks related to a cleaning cloth:

- the time needed for replacing them when they are dirty;
- the need for a careful and precise operation by the operator for their alignment and their attachment to the respective base;
- the need for a manual detachment from the base and a manual operation for attaching them back to the base;
- their precarious grip by the base even during normal cleaning operations.

SUMMARY OF THE INVENTION

The main purpose of the invention is to respond to one or more of the abovementioned drawbacks.

The main purpose of the invention is to make available a cleaning cloth that reduces the time needed to replace it.

Another purpose of the invention is to make available a cleaning cloth that can be attached to a base without any particular precautions on the part of the operator. Another purpose of the invention is to make available a cleaning cloth whose alignment and attachment between base and cloth is at least partly guided. Another purpose of the invention is to make available a cleaning cloth that is securely attached to the base.

Another purpose of the invention is to make available a cleaning cloth that is simple and inexpensive to make.

Another purpose of the invention is to make available a cleaning cloth that does not require accessories or to be equipped with other devices that increase its size in order to attain the above-mentioned purposes.

These and other purposes are all attained with the cleaning cloth with the coupling devices according to, the attached claims.

Exposition of the Invention

The technical characteristics of the invention, in line with the above-mentioned purposes, can be clearly found in the content of the claims reported below, and the benefits will become even clearer in the detailed description that follows, made with reference to the attached diagrams, which depict a realisation that is purely by way of example and non-limiting.

The cloth that is the object of this invention is particularly suited to be attached to a mop base that will be joined to a lengthwise edge of said cleaning cloth. More particularly, said mop base is a mop base equipped with a gripping mouth that can retain the cleaning cloth along one of its longitudinal edges.

Said mouth of the mop base has, near the protruding closure profile, one or more elements suited for various functions and modes of use.

These elements near the protruding closure profile are made of at least an element for limiting the opening and/or closing of the mouth, or at least an element capable of providing a support base and a notch between the two half frames hinged together in the close state, or at least an element capable of avoiding scraping and/or denting the movable surfaces or walls near where the cleaning takes place.

Because below in the description said elements are situated near the protruding closure profile, whatever their function and/or configuration, they are defined generally as notches.

The object of the invention is a cleaning cloth that can be attached to a mop base equipped with devices for holding at least part of the longitudinal edge of a cleaning cloth, where said cleaning cloth has, at least along one of its longitudinal edges, at least a recess and/or hollow that protrudes towards the inner part of the cloth, where said recess and/or hollow can work together with at least one of the notches near the protruding closure profile of the mouth of the mop base.

Said recess and/or hollow is configured as an interruption of the continuity of the perimeter edge, if situated in the central part and/or near the outer parts of each longitudinal side, and is configured as a step if situated at the side ends or corner of the cloth.

Beneficially, said recess and/or hollow is situated in the central part, maintaining the configuration basically unchanged and similar to that of a normal cloth, keeping costs low and providing a high degree of adaptability.

In this situation, moreover, the structure of the cloth is not compromised. Beneficially, said recess and/or hollow is situated near the outer areas of the longitudinal side, thereby able to provide the operator with a precise method for using the cloth in a precise and pre-set direction.

Beneficially, a recess and/or hollow is situated on the end, being configured as a step near the corner of the cloth; maintaining, however, the same dimensions of a normal cloth, and at the same time providing the operator with indications about the correct installation and the precision of the alignment with the base and also as a reference regarding the limitation of the depth inside the base.

Beneficially, said recess and/or hollows are positioned in a mirror-like arrangement on the longitudinal edges, thereby facilitating the use of the cloth and in particular its attachment that can take place equally on any longitudinal side of the cloth, but maintaining an indication on the direction adopted. Beneficially, said cloth with these recesses and/or hollows has a double active face, therefore said recess and/or hollow being able to acquire additional significant uses, like pointing out the correct side used with respect to the base, or else rendering biunique the joint between the side of the cloth and the outer surface of the base to which it is joined.

Beneficially, said recesses and/or hollows are symmetrical rendering practically universal the adoption, in any manner, both the positioning of the cloth on the floor, as well as one side or the other, with a base that is in any event orientated. Beneficially the profile or said recess and/or hollow has a stop composed practically of the side parallel to the longitudinal outer perimeter edge of the cloth; said stop works together with the respective notch on the base, especially to establish and limit the cloth from connecting to the respective base.

Beneficially the profile of said recess and/or hollow has at least one lateral side that is practically recessed with respect to the outer longitudinal perimeter edge of the cloth, which has the function of working with the lateral shoulder of the respective notch on the base, in order to prevent and/or limit the longitudinal sideways movements of the cloth with respect to the base and to prevent the detachment of the cloth from the base, slipping from the relative gripping hold. A further benefit of this recessed lateral inclination of at least one side of the profile of said recess and/or hollow, positioned in a slanting manner with respect to the outer longitudinal perimeter edge of the cloth, has the task of autocentring, greatly helping the operator when bringing the cloth and base close together for their precise attachment.

DESCRIPTION OF THE DRAWINGS

The detailed description below makes reference to the attached diagrams, which represent purely an exemplary form that is in no way restrictive, where.

DETAILED DESCRIPTION OF THE PREFERRED EMBODIMENT

Figure 1:
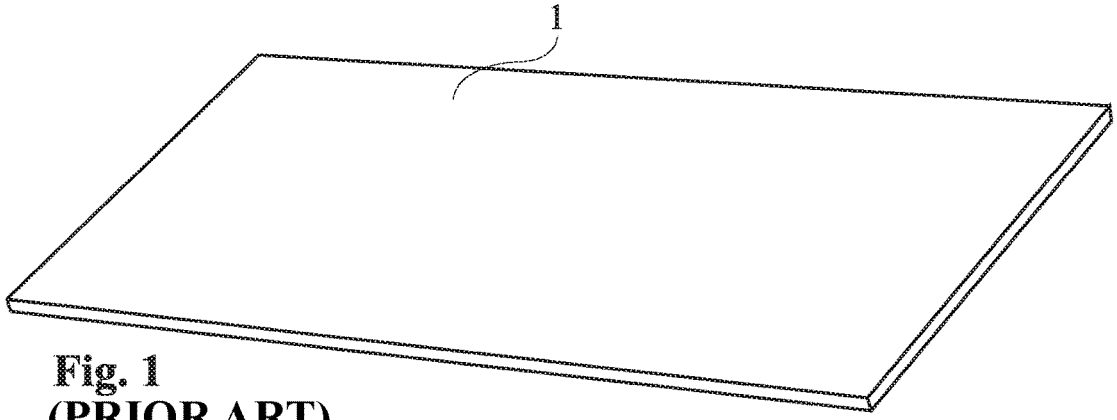
Fig. 1 (PRIOR ART)
FIG. 1 shows a generic cloth with a rectangular configuration.
Figure 2:
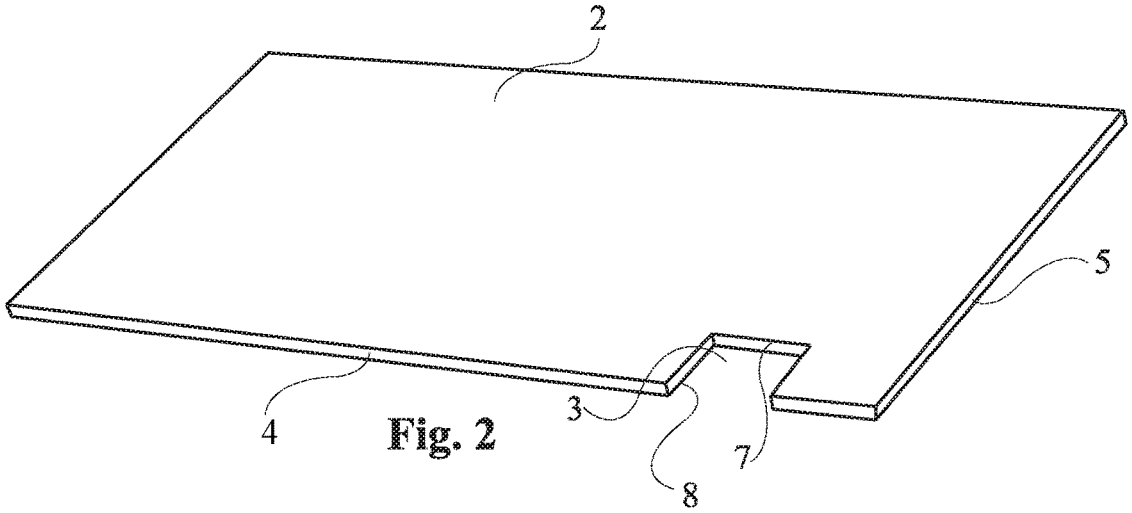
FIG. 2 shows the cloth of this invention equipped with a recess positioned in an intermediate position along a longitudinal edge, but not in a corner.
Figure 3:
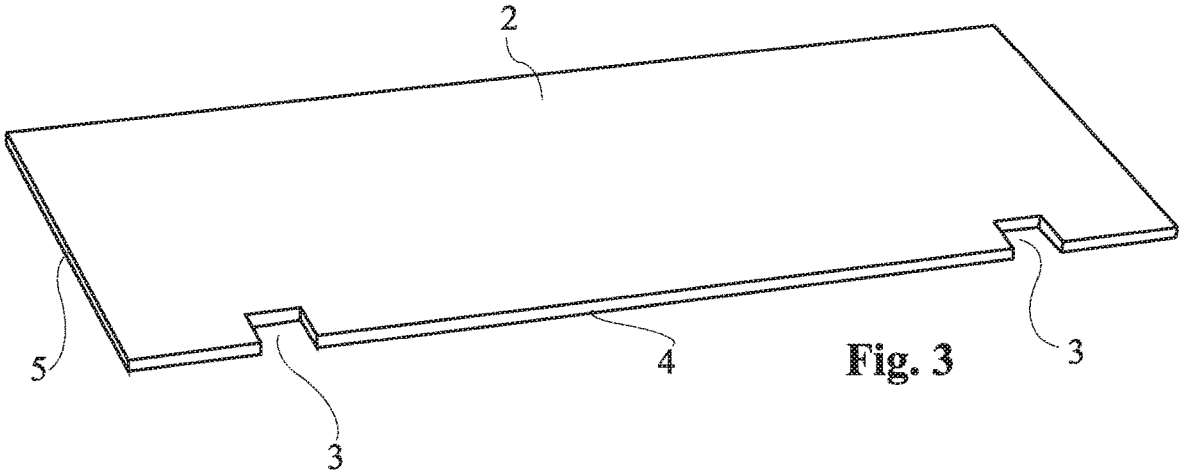
FIG. 3 shows the cloth of this invention with a pair of recesses situated on a longitudinal edge near the outer parts of said edge.
Figure 4:
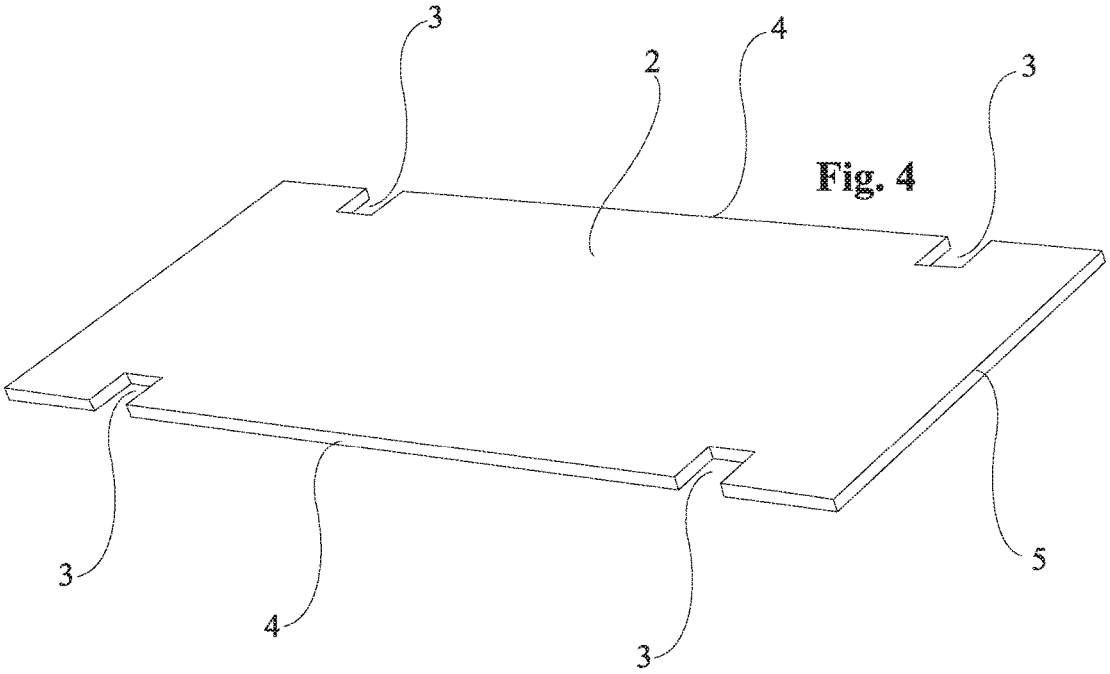
FIG. 4 shows the cloth of FIG. 3 where said pair of recesses is positioned in a symmetrical manner on both longitudinal edges.
Figure 5:
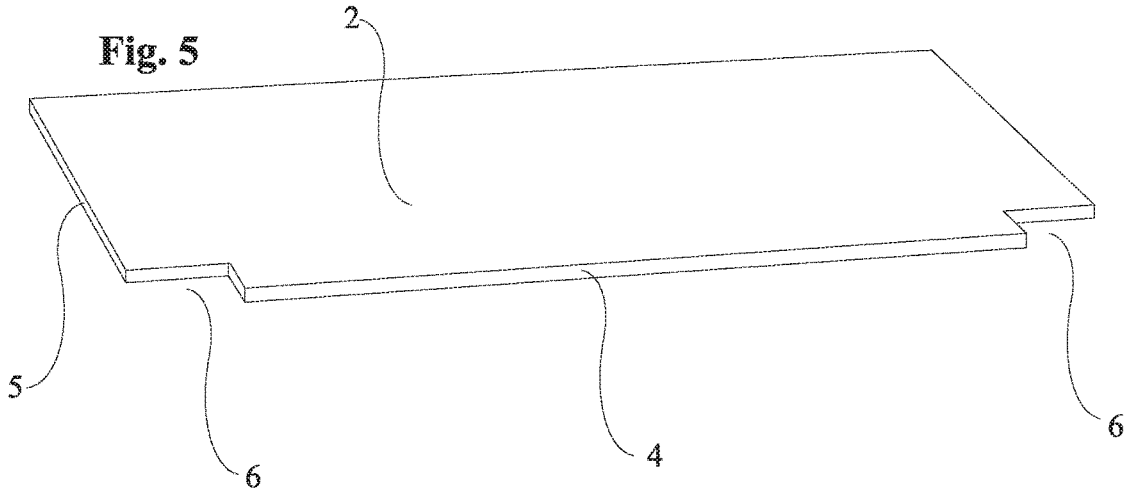
FIG. 5 shows the cloth of this invention equipped with a pair of recesses positioned on a longitudinal edge at the end on the corner.
Figure 6:
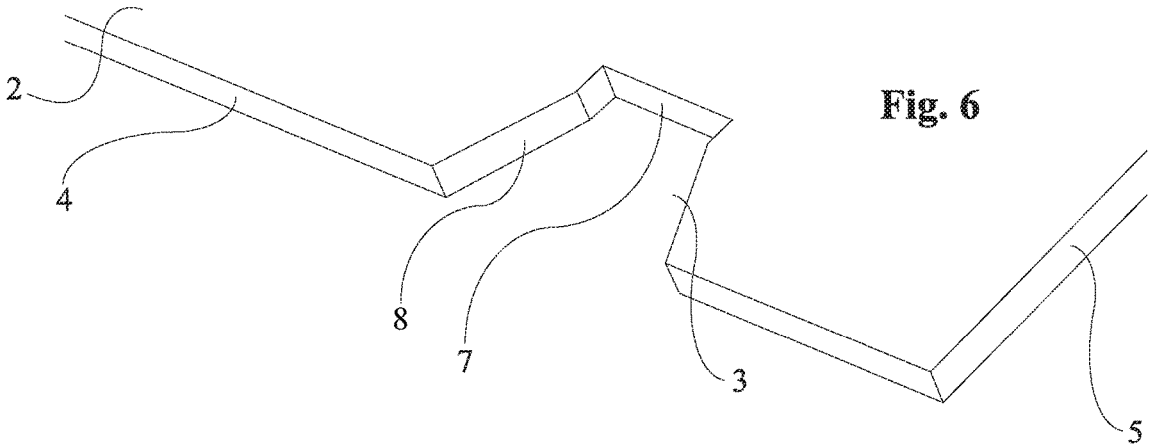
FIG. 6 shows the details of a profiled recess with a flared opening for autocentring with respect to a notch on the mouth of a base that has to be used.
Figure 7:
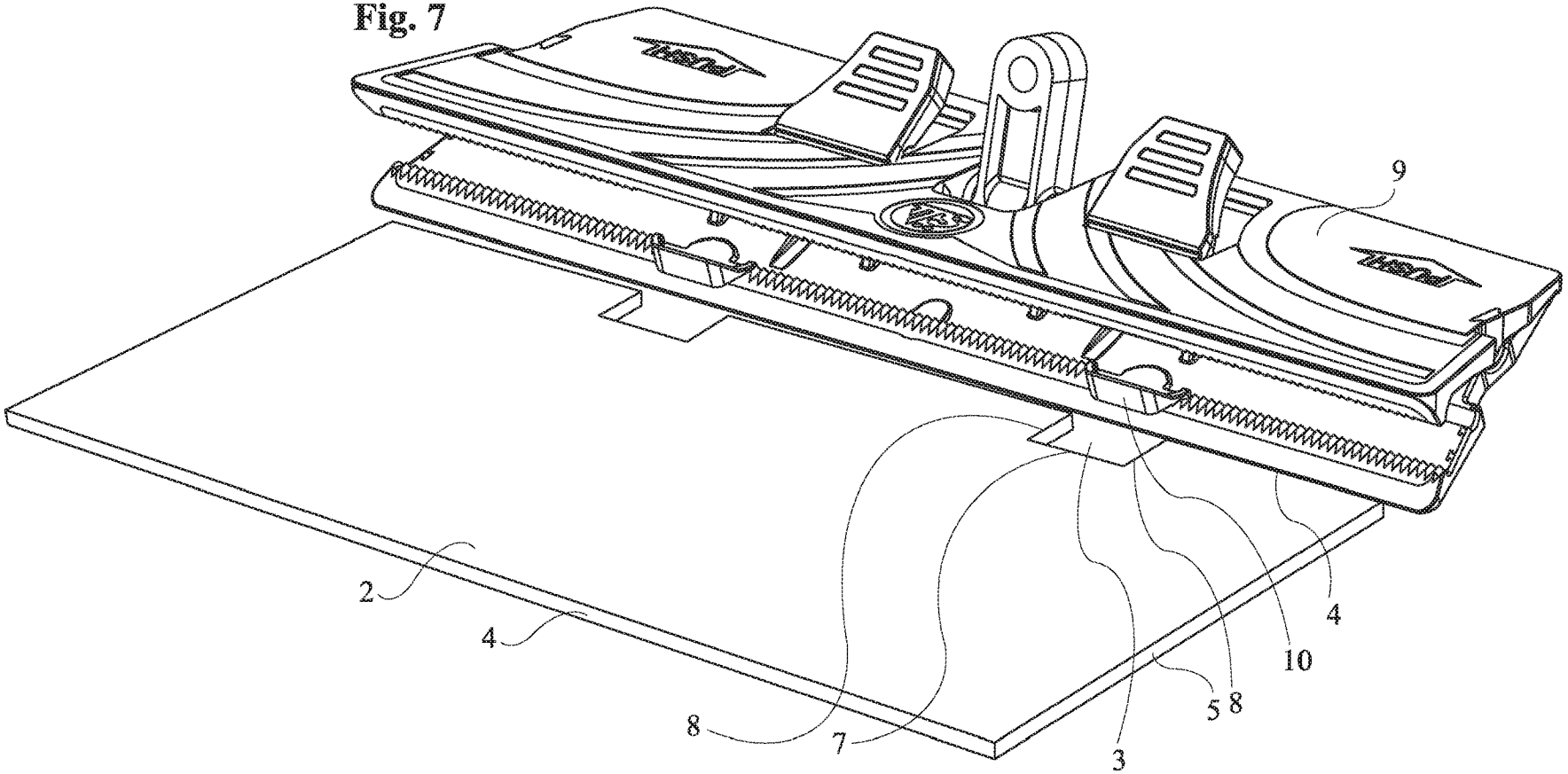
FIG. 7 shows the cloth of this invention equipped with a pair of recesses positioned on the longitudinal edge near the mouth which has notches, of a base in the process of being joined.

With reference to the diagrams, we see that the generic cleaning cloth 1 has a perimeter whose edges are continuous without any recesses or any particular shaping.

This cloth is subject to all the above-mentioned drawbacks when used in association with a mop base and during the attachment stage.

This cloth in prior art in combination with a mop base fitted with a gripping mouth would have difficulty in being correctly gripped and precisely aligned, not having any reference points.

Moreover, said cloth would not be easily held tightly when subjected to longitudinal stresses, namely along the longest retention edge.

The cloth 2 that is the object of the invention and fitted with coupling devices that are configured as one or more recesses 3 on the longitudinal edge 4 allows many of the beneficial features described above to be attained. In fact, a simple recess 3 allows the operator to immediately check the correct approach to the base 9, through an assessment of the alignment, and providing for a quick attachment.

Said recess 3 has a stop 7 to limit the entry of the cloth 2 until it reaches the correct insertion length.

In this way the operator, because he does not have to worry about any excessive insertion of the cloth 2, he proceeds with the quick and efficient connection between the cloth 2 and the base 9, and therefore renders this connection solid with the closure of the retention grip.

Moreover, this facilitated connection is improved by providing more recesses 3, preferably positioned near the side pats of the cloth 2.

With this arrangement of the recesses 3, making it always easy to make a connection because of being able to check the correct alignment of the base 9 with the cloth 2, you also ensure a secure connection with the parallel arrangement between the longitudinal edge 4 of the cloth 2 and the base 9 of the mop.

The method for making the recesses 3 positioned at the lateral ends or in the corner with the transversal edge 5 of the cloth 2, configured therefore as a step 6 positioned on the longitudinal retention edge 4, meets both inexpensive manufacturing requirements, and also has the benefit of not interrupting the continuity of the longitudinal profile, a very important aspect in the eventuality that cloths are used that are not very thick or solid.

In fact, to interrupt the continuity of the profile of thin cloths could involve the•risk of arrangements that are unfavorable for the correct attachment to the base 9 when set on the floor by the operator without any particular precautions, with recesses and/or folds lying overlapped.

The benefit of being able to easily make the recesses 3, arranged symmetrically along the same longitudinal edge 4, makes the cloth easily manageable also in the eventuality of a cloth 2 with a double active cleaning surface, therefore being able to be set on the floor by the operator regardless of the cloth side without any problems.

Lastly, by providing a mirror-like configuration on both longitudinal edges 4 of said recesses 3 helps the operator to join the cloth 2 to the base 9 without having to worry about being the right way round.

These recesses beneficially have an auto-centering profile, with the opening more flared towards the outside.

It is immediately clear that thanks to this profile of the recesses 3, the joining of the base and the cloth is really quick and easy, and at the same time precise. In fact, the operator only has to bring the base 9 close to the cloth 2, helped by the visible notches of the recesses 3, with a narrow degree of alignment, and he can proceed with a certain margin of tolerance, in the certainty that an auto•centered association will take place and one that is limited to the correct insertion length.

The limitation of the cloth 2 to the correct insertion length inside the base 9 is established by the edge 7 of the recess, generally parallel to the longitudinal edge 4 of the cloth, which comes up against the notches 10 on the base 9.

The recesses of the above description can have one or more perpendicular edges or ones arranged obliquely with respect to the longitudinal retention edge 4 that joins to the respective base 9.

Said edges 8 usefully work together with the notches 10 on the base 9, and in particular with the lateral shoulders of the notches 10 with the aim of giving the cloth 2 sufficient stability to prevent detachment.

In fact, as is well known the gripping is usually provided against the perpendicular slipping, while there is ~o provision for lateral retention. Now since very often cleaning operations also involve stresses along the longitudinal axis of the base 9, like for example cleaning along the edges of furniture or walls, it is clear that an inadequate gripping of the cloth 2 leads to the detachment of the base 9 to which it is joined.

In order to prevent and impede this detachment, the perpendicular edges 8 of the recesses 3 limit and impede the shifting of the cloth 2, resting on the lateral shoulders of the notches 10.

Clearly there can be cooperation between the edges 8 of the diverse and distant recesses 3, both in the same direction, but also and especially in directions opposite to the shifting of the cloth 2.

The invention arranged in this way therefore attains the aims that have been set out.

Obviously, it could take on, in its practical realization, also forms and configurations different from that illustrated above without leaving the present ambit of protection.

Moreover, all the particular features could be replaced by technically equivalent elements and the dimensions, shapes and material used could vary according to requirements.

What is claimed is:

1. A cleaning cloth capable of being joined to a mop base equipped with a device for retaining at least part of a lengthwise edge of the cleaning cloth, wherein said cleaning cloth has, at least along its lengthwise edge, at least a first pair of recesses that extends towards an inner part of the cloth, said at least the first pair of recesses being capable of working with at least one locator near a protruding profile of the mop base for closing a mouth of the mop base, said at least the first pair of recesses having opposing side walls, wherein the first pair of recesses is disposed along one lengthwise edge, the cleaning cloth having an outer perimeter edge defining an outer perimeter of the cleaning cloth, wherein the cleaning cloth is solid and continuous within the outer perimeter of the cleaning cloth, wherein the first pair of recesses extend inward from the outer perimeter edge, wherein the opposing side walls of each recess are recessed at a slant with respect to the lengthwise edge of the cloth, which cooperates with a lateral shoulder of the respective locator on the base to facilitate auto-centering, and wherein the outer perimeter edge forms right angles at corners thereof.

2. The cleaning cloth according to claim 1, further including a second pair of recesses on an opposite lengthwise edge of the cloth and arranged in a mirror-like fashion with the first pair of recesses.

3. The cleaning cloth according to claim 1, wherein said cloth can be used on both sides.

4. The cleaning cloth according to claim 1 wherein each recess of said first pair of recesses is positioned in a symmetrical manner about a midpoint along the lengthwise edge of the cloth.

5. The cleaning cloth according to claim 1 wherein each recess includes a limit stop comprising a side that is substantially parallel to the lengthwise edge of the cloth, which cooperates with the respective locator on the base.

6. The cleaning cloth according to claim 1 wherein the opposing side walls of each recess is recessed with respect to the lengthwise edge of the cloth, which cooperates with a lateral shoulder of the respective locator on the base.

7. A cleaning system comprising:

a cleaning cloth having, at least along its lengthwise edge, at least a first pair of recesses that extends toward an inner part of the cleaning cloth;

a mop base equipped with a device for retaining at least part of a lengthwise edge of the cleaning cloth;

at least a pair of locators formed near a protruding profile of the mop base for closing a mouth of the mop base; and the first pair of recesses extend toward an inner part of the cloth, each of the recesses having opposing side walls, wherein each of the recesses working with each locator to align the cleaning cloth on the mop base, and the cleaning cloth has an outer perimeter edge defining an outer perimeter of the cleaning cloth, wherein the cleaning cloth is solid and continuous within the outer perimeter of the cleaning cloth, wherein the outer perimeter edge forms right angles at corners thereof.

8. The cleaning system according to claim 7, wherein a second pair of recesses are arranged in a mirror-like fashion on a lengthwise edge, opposite the first pair of recesses, of the cloth.

9. The cleaning system according to claim 7, wherein said cloth can be used on both sides.

10. The cleaning system according to claim 7, wherein each recess is positioned in a symmetrical manner about a midpoint along the lengthwise edge of the cloth.

11. The cleaning system according to claim 7, wherein each recess includes a limit stop comprising a side that is substantially parallel to the lengthwise edge of the cloth, which cooperates with the locator on the mop base.

12. The cleaning system according to claim 7 wherein the opposing side walls of each recess are recessed at a slant with respect to the lengthwise edge of the cloth, which cooperates with a lateral shoulder of the respective locator on the base to facilitate auto-centering.

* * * * *